US009074341B2

(12) United States Patent
Schroeppel et al.

(10) Patent No.: US 9,074,341 B2
(45) Date of Patent: Jul. 7, 2015

(54) TRENCH WALL CUTTER AND METHOD FOR PRODUCING A TRENCH IN THE GROUND

(71) Applicant: Bauer Spezial Tiefbau GmbH, Schrobenhausen (DE)

(72) Inventors: Christoph Schroeppel, Harburg (DE); Stefan Schindler, Thalhausen/Altomuenster (DE)

(73) Assignee: Bauer Spezialtiefbau GmbH, Schrobenhausen (DE)

( * ) Notice: Subject to any disclaimer, the term of this patent is extended or adjusted under 35 U.S.C. 154(b) by 75 days.

(21) Appl. No.: 13/777,859

(22) Filed: Feb. 26, 2013

(65) Prior Publication Data

US 2013/0227862 A1 Sep. 5, 2013

(30) Foreign Application Priority Data

Mar. 5, 2012 (EP) ..... 12001469

(51) Int. Cl.

| | |
|---|---|
| ***E02F 5/08*** | (2006.01) |
| ***E02D 17/13*** | (2006.01) |
| ***E02F 3/20*** | (2006.01) |
| ***E02F 3/24*** | (2006.01) |

(52) U.S. Cl.

CPC . *E02F 5/08* (2013.01); *E02D 17/13* (2013.01); *E02F 3/205* (2013.01); *E02F 3/241* (2013.01)

(58) Field of Classification Search

USPC ..... 37/91, 94, 104; 299/39.1, 55
IPC ..... E02F 3/241,3/245, 5/08
See application file for complete search history.

(56) References Cited

U.S. PATENT DOCUMENTS

| | | | | | |
|---|---|---|---|---|---|
| 3,398,616 | A | * | 8/1968 | Elineau | 83/305 |
| 4,624,605 | A | * | 11/1986 | Akesaka | 405/144 |
| 4,850,123 | A | * | 7/1989 | Whitaker, Jr. | 37/104 |
| 5,396,962 | A | * | 3/1995 | Reincke | 172/604 |

(Continued)

FOREIGN PATENT DOCUMENTS

| | | | |
|---|---|---|---|
| DE | 102007035591 | B3 | 10/2008 |
| EP | 1 703 023 | A1 | 9/2006 |

(Continued)

OTHER PUBLICATIONS

The European Search Report dated Apr. 30, 2012, which corresponds to EP 12 00 1469 and is related to U.S. Appl. No. 13/777,859.

(Continued)

*Primary Examiner* — Gary Hartmann
(74) *Attorney, Agent, or Firm* — Studebaker & Brackett PC

(57) ABSTRACT

The invention relates to a trench wall cutter for producing a trench in the ground having a cutter frame and at least one cutting wheel which is supported in a rotatable manner about an axis of rotation on the cutter frame and has at its outer circumference a plurality of ground working tools for removing ground material. The ground working tools are arranged along an annular path around the axis of rotation. Provision is made for the annular path to run asymmetrically to the axis of rotation of the cutting wheel, wherein the annular path has at least one first circumferential section with a larger distance from the axis of rotation and at least one second circumferential section with a smaller distance from the axis of rotation. The invention furthermore relates to a method for producing a trench in the ground.

12 Claims, 4 Drawing Sheets

(56) References Cited

U.S. PATENT DOCUMENTS

| | | | | |
|---|---|---|---|---|
| 5,575,537 | A * | 11/1996 | Kogler et al. | 299/31 |
| 5,791,737 | A * | 8/1998 | Cochran | 299/39.8 |
| 6,547,484 | B2 * | 4/2003 | Murphy | 404/124 |
| 7,152,346 | B2 * | 12/2006 | Arzberger | 37/189 |
| 7,178,273 | B2 * | 2/2007 | Arzberger | 37/189 |
| 7,356,947 | B2 * | 4/2008 | Arzberger | 37/189 |
| 7,661,209 | B2 | 2/2010 | Arzberger et al. | |
| 7,677,324 | B2 * | 3/2010 | Jones et al. | 172/97 |
| 7,845,098 | B1 * | 12/2010 | Huebner et al. | 37/104 |
| 7,987,620 | B2 * | 8/2011 | Huebner et al. | 37/104 |
| 2006/0225308 | A1 | 10/2006 | Arzberger et al. | |
| 2009/0031590 | A1 | 2/2009 | Arzberger et al. | |
| 2011/0253450 | A1 | 10/2011 | Arzberger et al. | |
| 2014/0013634 | A1 * | 1/2014 | Huber | 37/365 |

FOREIGN PATENT DOCUMENTS

| | | | |
|---|---|---|---|
| EP | 2 378 002 | A1 | 10/2011 |
| JP | 2004-251057 | A | 9/2004 |
| JP | 2009-191464 | A | 8/2009 |
| JP | 2011-006962 | A | 1/2011 |
| KR | 2006-0101252 | A | 9/2006 |
| KR | 2011-0115977 | A | 10/2011 |

OTHER PUBLICATIONS

An Office Action; "Notice of Allowance," issued by the Korean Patent Office on Aug. 18, 2014, which corresponds to Korean Patent Application No. 10-2013-0022603 and is related to U.S. Appl. No. 13/777,859; with English language translation.

* cited by examiner

TRENCH WALL CUTTER AND METHOD FOR PRODUCING A TRENCH IN THE GROUND

TECHNICAL FIELD

The invention relates to a trench wall cutter and to a method for producing a trench in the ground.

BACKGROUND

A trench wall cutter of such type comprises a cutter frame and at least one cutting wheel which is supported in a rotatable manner about an axis of rotation on the cutter frame and has at its outer circumference a plurality of ground working tools for removing ground material, which are arranged along an annular path around the axis of rotation.

In the known method for producing a trench in the ground through removal of ground material at least one cutting wheel, which is supported in a rotatable manner on a cutter frame, is driven in a rotating manner and with a plurality of ground working tools, which are arranged at an outer circumference of the cutting wheel, ground material is removed, wherein the ground working tools are arranged on an annular path around the axis of rotation.

A trench wall cutter of the stated type is described in DE 10 2007 035 591 B3 for example.

SUMMARY

The invention is based on the object to provide a trench wall cutter and a method for producing a trench in the ground, which enable a particularly economical trench wall production.

In accordance with the invention the object is achieved by a trench wall cutter discussed in detail hereinbelow and by a method for producing a trench in the ground also discussed in detail hereinbelow. Preferred embodiments of the invention are stated in the dependent claims.

According to the invention the trench wall cutter is characterized in that the annular path runs asymmetrically to the axis of rotation of the cutting wheel, wherein the annular path has at least one first circumferential section with a larger distance from the axis of rotation and at least one second circumferential section with a smaller distance from the axis of rotation.

According to the invention the method is characterized in that the annular path runs asymmetrically to the axis of rotation of the cutting wheel, wherein the annular path has at least one first circumferential section with a larger distance from the axis of rotation and at least one second circumferential section with a smaller distance from the axis of rotation and wherein during operation the trench wall cutter is set into a defined oscillation.

In the present case, an annular path running asymmetrically to the axis of rotation of the cutting wheel is understood, in particular, as an annular path that deviates from a circular path whose center is constituted by the axis of rotation of the cutting wheel.

A first fundamental idea of the invention can be seen in the fact that a defined non-circular running of the cutting wheel is generated by the asymmetrical arrangement of the ground working tools. The non-circular running is accomplished by the fact that the annular path, on which the ground working tools are arranged in the circumferential direction, does not represent a circular path around the axis of rotation of the cutting wheel as center of circle. Hence, the ground working tools are arranged divergent from a circular path that is point-symmetrical to the axis of rotation of the cutting wheel. In at least one first section of the circumference the ground working tools are located further away from the axis of rotation and in at least one second section they are located closer to the axis of rotation.

As a result of the non-circular running, impulse forces act on the ground working tools or alternatively on the ground to be removed. This brings about an improved transformation of energy when the ground working tools penetrate the ground. Especially in the case of hard ground, such as rock or concrete, an improved ground removal and a higher cutting progress can thus be achieved.

The ground working tools can be cutting teeth, chisels, rolls or rollers in particular. The ground working tools serve to loosen or remove ground material for producing a trench in the ground, for which purpose they are arranged at an outer circumference of the cutting wheel.

The distance of the ground working tools from the axis of rotation of the cutting wheel changes in a defined way, in particular stepwise, in the circumferential direction along the annular path. In particular, the ground working tools are arranged such that the distance from the axis of rotation increases and decreases periodically along the annular path along several ground working tools at a time. By preference, the distance of the ground working tools from the axis of rotation increases successively in the circumferential direction of the cutting wheel along a first section across a plurality of ground working tools and then decreases successively again along a second section across a plurality of ground working tools. On rotation of the cutting wheel about its axis of rotation the ground working tools arranged in accordance with the invention cause a periodically changing distance of the axis of rotation to the emerging ground to be cut.

The annular path, on which the ground working tools are arranged around the cutting wheel, can, in particular, be offset and/or distorted with respect to a circular path that is point-symmetrical to the axis of rotation of the cutting wheel. The ground working tools are arranged on an annular path that is rotationally unsymmetrical to the axis of rotation of the cutting wheel, i.e. a rotation of the cutting wheel about any chosen angle does not reproduce the annular path onto itself but rather produces an annular path that is offset and/or twisted with respect to the original annular path.

The annular path, along which the ground working tools are arranged, can also be referred to as cutting path. Through a rotation of the cutting wheel the position and/or alignment of the cutting path changes with respect to the axis of rotation of the cutting wheel.

By preference, due to the fact that the annular path is asymmetrical to the axis of rotation of the cutting wheel a defined oscillation of the trench wall cutter can be generated in particular through contact of the ground working tools with the ground to be removed.

Therefore, another advantage resides in the fact that the trench wall cutter is set into a defined oscillation. On account of the weight of the trench wall cutter and/or a generated pressing force a lower circumferential section of the cutting wheel rests on the bottom of the trench during operation. Due to the fact that the distance of the ground working tools from the axis of rotation changes in the circumferential direction of the cutting wheel, the axis of rotation of the cutting wheel is moved up and down periodically when the respective ground working tools positioned below make contact with the bottom of the trench. This leads to an oscillation of the cutter frame and the trench wall cutter respectively.

As a result of the oscillation of the trench wall cutter the dynamic force on the ground working tools is increased further and a percussive ground removal is rendered possible. Hence, in addition to being crushed the ground can also be loosened through percussion, whereby frictional wear on the ground working tools can be reduced and an even more effective ground removal can be realized.

It has been shown that an effective ground removal is achieved in that in one revolution along the annular path the distance of the ground working tools from the axis of rotation ranges between one and five, preferably one to three, more preferably one or two maxima—and minima accordingly. The impacts or oscillations that can be effected per revolution of the cutting wheel correspond to the number of maxima and minima respectively. The number of maxima and minima according to the invention ensures an effective oscillation, especially with an adequate amplitude.

A possibility of providing the asymmetrical annular path resides in the fact that the annular path, along which the ground working tools are arranged, has a shape deviating from a circular path, in particular having an elliptical shape. In this case, the axis of rotation of the cutting wheel can be located in the geometrical center of the cutting wheel or in the ring center of the annular path.

Another possibility of providing the asymmetrical annular path resides in the fact that the axis of rotation of the cutting wheel is offset with respect to a geometrical ring center of the annular path. In this case, the axis of rotation is arranged eccentrically with respect to the ground working tools arranged along the annular path.

It is particularly preferred that the annular path is a circular path, the geometrical center of which is arranged eccentrically or offset to the axis of rotation. With regard to the manufacturing technique such an axis of rotation arranged eccentrically to the circular path of the ground working tools can be achieved with particular ease by providing a hub located eccentrically to the center of circle.

The eccentricity of the annular path, in particular being of elliptical shape, or the offset of the axis of rotation with respect to the ring center or center of circle preferably ranges between a few millimeters or centimeters and approximately one or two decimeters. In another preferred embodiment the difference between a maximum distance and a minimum distance of the ground working tools from the axis of rotation amounts to approximately a few millimeters or centimeters and one or two decimeters.

To adapt the trench wall cutter to different ground geologies it is preferred that the position of the annular path or the axis of rotation of the cutting wheel is adjustable. For example in the case of harder ground formations a greater eccentricity of the cutting wheel can be set as compared to softer ground types.

It is especially preferred that a cutting wheel hub is provided, which is arranged concentrically to the axis of rotation and driven in a rotatable manner about the latter, that the ground working tools are releasably fixed in an annular rim and that the annular rim is releasably and/or adjustably fixed on the cutting wheel hub. In particular, the annular rim can have a plurality of receiving parts for the ground working tools, in which case the receiving parts for the ground working tools are arranged along the annular path. Basically, the annular rim can be firmly arranged on the cutting wheel hub, in particular it can be welded thereto. Through a releasable arrangement of the annular rim on the cutting wheel hub the annular rim can be replaced particularly easily, for example in the case of wearing of the ground working tools. Moreover, it is possible to alternatively fix annular rims of different designs on a pre-assembled cutting wheel hub in order to take account of different ground conditions for example. An annular rim which is adjustably fixed on the cutting wheel hub is to be understood, in particular, in that the eccentricity of the annular rim can be varied with respect to the cutting wheel hub. This can be ensured for example by providing slotted holes on the annular rim and/or on the cutting wheel hub for fixing elements, such as screws or bolts. The annular rim can have the shape of a circular ring or a design divergent from the circular shape, such as an elliptical shape.

Alternatively or additionally, between a drive shaft and the cutting wheel an adjustment means, such as adjustable connecting plates, can be arranged, allowing the cutting wheel as an assembly group to be radially adjustable with respect to the drive shaft and its axis of rotation.

To further improve the ground removal or alternatively to enhance the excitation of oscillations, several cutting wheels arranged in pairs are preferably supported on the cutter frame, which can be driven synchronously to each other in a controlled manner. This is to be understood, in particular, in that the individual cutting wheels are driven at the same rotational speeds and, in addition, preferably with the same angles of rotation so that the cutting wheels bring about identical up and down movements of the trench wall cutter that increase the oscillation of the trench wall cutter. By preference, the cutting wheels have mutually synchronized cutter transmissions.

Depending on the nature of the ground it can also be of advantage that several cutting wheels are supported on the cutter frame, which can be driven asynchronously to each other in a controlled manner. This can be understood, on the one hand, in that the individual cutting wheels are driven at different rotational speeds. It is also possible and preferred that cutting wheels of different designs, i.e. cutting wheels with different annular paths, are used. In this connection it is especially preferred that the individual cutting wheels are driven at identical speeds, while the angles of rotation, as seen in relation to the alignment of the annular path to the axis of rotation, are offset to each other.

Between the individual cutting wheels a defined phase shift can be set with regard to eccentricity. For instance, in the individual cutting wheels of a coaxial cutting wheel pair with an elliptical annular path the respective path maximum of the cutting wheels can be twisted in relation to each other by 90°, i.e. phase-shifted. This results in a superposition of the oscillations of both cutting wheels.

A further superposition of oscillations in a trench wall cutter with two cutting wheel pairs is achieved in that the first and the second cutting wheel pair are of identical design but are arranged to each other and driven at a 45° angle offset. This results in a superposition of four oscillations that are phase-shifted by 45° in relation to one another. The cutting wheels can be arranged coaxially to each other and/or offset parallel to each other. Basically, both a unidirectional and a counter-directional drive are possible.

For the production of a trench wall in the ground it is preferred that a supply means for supplying a hardening medium is arranged on the cutter frame. In particular, the supply means can comprise a supply opening, via which the hardening medium, as for example concrete, can be introduced into the produced trench. After recovery of the trench wall cutter the medium introduced into the trench hardens to form a trench wall element.

In a further preferred embodiment the at least one cutting wheel of the trench wall cutter has at least one hinged tooth as a ground working tool. Such a hinged tooth constitutes a pivotably supported ground working tool which pivots inwards when passing the cutter frame, in particular a cutting shield on which the cutting wheel is supported, and pivots outwards below the cutter frame in order to remove ground material below the cutter frame. If several cutting wheels are arranged opposite one another, the hinged teeth are preferably offset to each other in the circumferential direction to avoid any mutual influences.

In a further aspect the invention relates to a cutting device having a carrier implement, on which a trench wall cutter is arranged substantially in a vertically adjustable manner. According to the invention, on such a cutting device a trench wall cutter as described above is arranged. The carrier implement can, in particular, be a carrier implement with an undercarriage and an upper carriage supported thereon in a rotatable manner. By preference, a mast is linked to the upper carriage, on which the trench wall cutter is suspended. For example the trench wall cutter can be suspended on a rope. To control the position of the trench wall cutter in the ground control means, such as control flaps and/or control wheels, can be provided. Alternatively, it is possible to provide a fixed guide means, such as a guide bar, on which the trench wall cutter is suspended.

DESCRIPTION OF THE DRAWINGS

In the following the invention is described further by way of the accompanying schematic drawings, wherein show.

DETAILED DESCRIPTION

Identical components or those having the same effect are designated in all Figures with the same reference signs.

Figure 1:
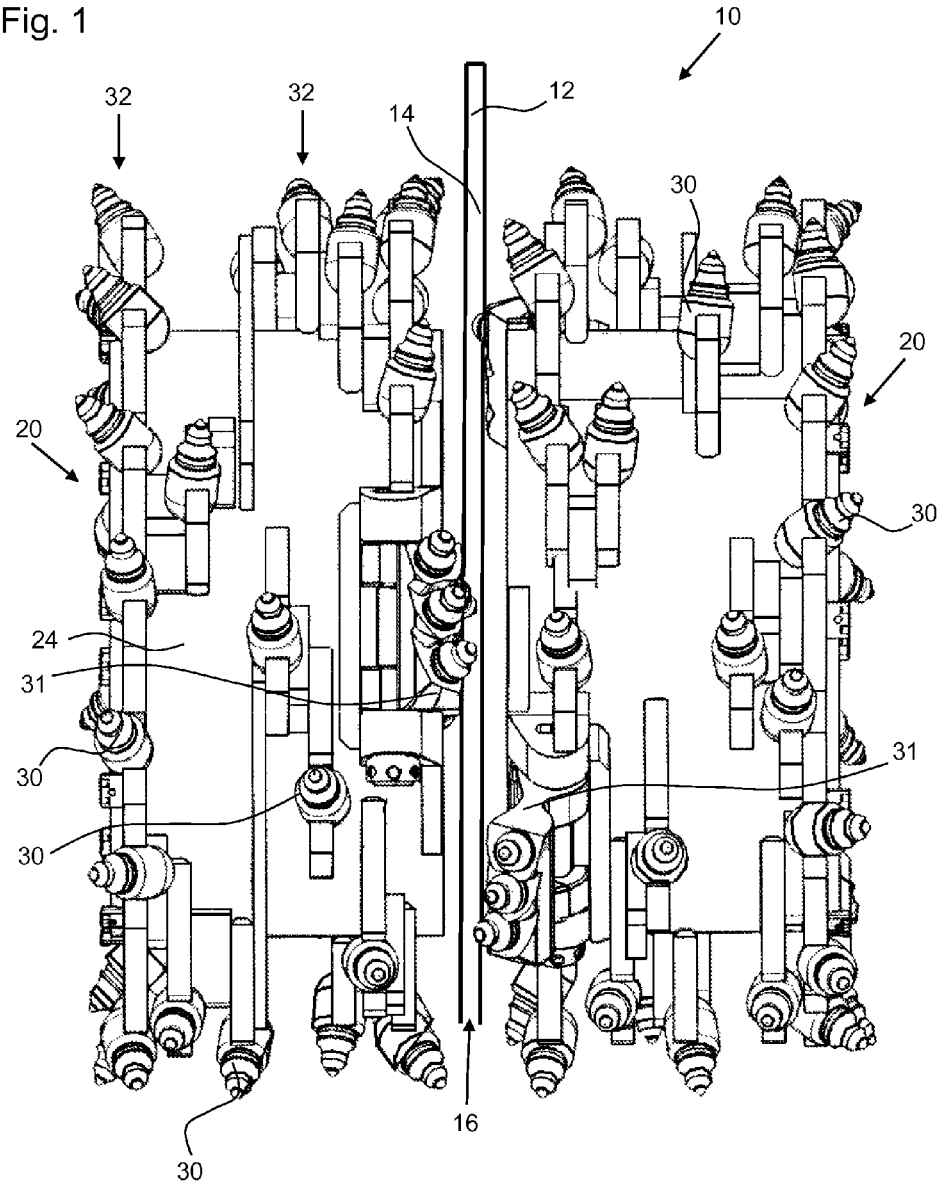
FIG. 1 a trench wall cutter according to the invention with two cutting wheels.

In FIG. 1 a trench wall cutter 10 in accordance with the invention is shown. The trench wall cutter 10 comprises a cutter frame 12, on which several cutting wheels, for example two, four or eight cutting wheels 20 are supported in a rotatable manner. The cutter frame 12 preferably comprises one or several cutting shields 14, on which the cutting wheels 20 are supported. At least one cutting wheel 20 is preferably arranged in a lower area of the cutter frame 12 for the removal of ground material in order to produce, in particular, a vertical trench in the ground.

The cutting wheels 20 are each supported in a rotatable manner about an axis of rotation 22 and have at their outer circumference 24 a plurality of ground working tools 30 for the removal of ground material. The ground working tools 30, for example cutting teeth, chisels or rolls, are distributed in the circumferential direction around the cutting wheel 20. The ground working tools 30 can be arranged in the axial direction of the cutting wheel 20 along different paths or on different levels. Each cutting wheel can have a pivotably supported ground working tool, in particular a hinged tooth 31.

To supply a hardening medium into the produced trench the trench wall cutter 10 comprises a supply means 16 with a supply opening. The supply means 16 can be arranged in a lower area of the cutter frame 12.

Figure 2:
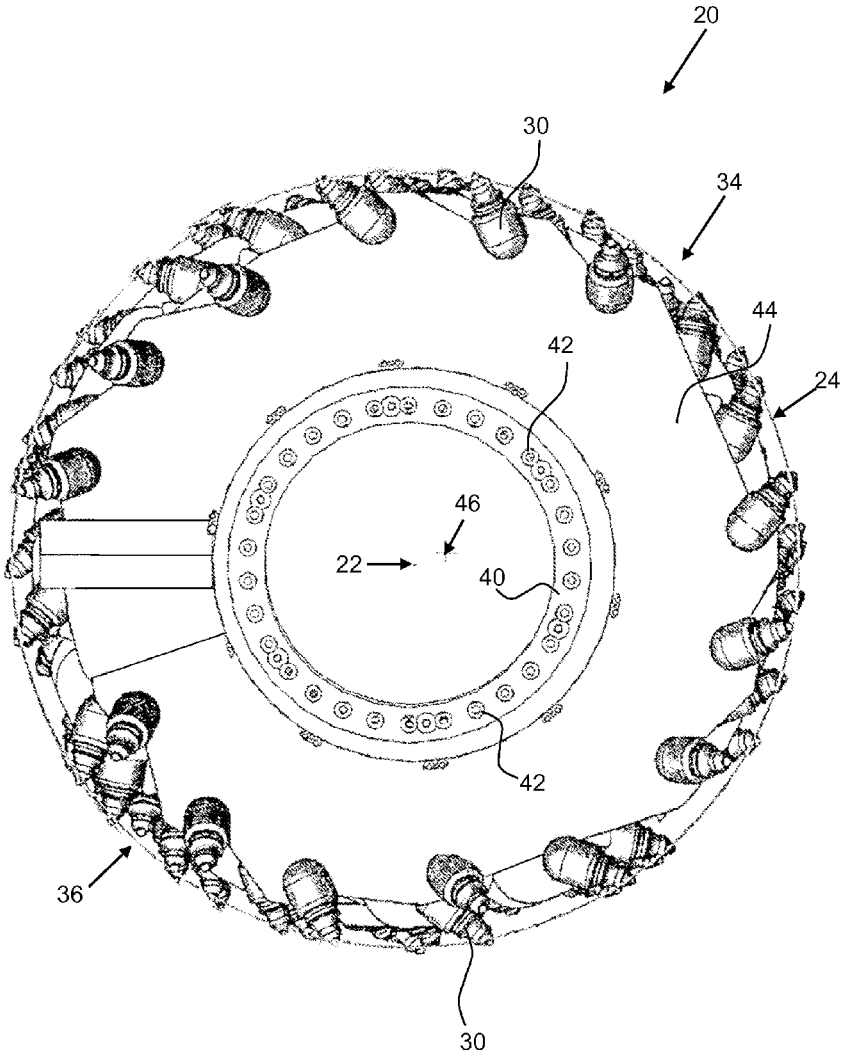
FIG. 2 a first embodiment of a cutting wheel according to the invention.

A first embodiment of a cutting wheel 20 according to the invention is shown in FIG. 2. The cutting wheel 20 concerned here is a circular cutting wheel, i.e. the ground working tools 30 are arranged on a circular path around a center 46 of the cutting wheel 20, which can also be referred to as ring center or center of circle. Thus, the ground working tools 30 run in the circumferential direction of the cutting wheel 20 on an annular path 32 that is designed as a circular path.

The axis of rotation 22 of the cutting wheel 20 is arranged eccentrically to the geometrical center 46 of the cutting wheel 20 and the annular path 32 respectively so that the axis of rotation 22 and the geometrical center 46 do not coincide. As a result of this offset a defined non-circular running is generated during a rotation of the cutting wheel 20. Along a first circumferential section 34 of the cutting wheel 20 the ground working tools 30 are located closer to the axis of rotation 22 than along a second circumferential section 36 which is offset to the first circumferential section 34 in the circumferential direction.

On rotation of the cutting wheel 20 about its axis of rotation 22 the cutting path of the cutting wheel 20 oscillates periodically. In other words, the ground working tools 30 progressing past oscillate periodically in the radial direction in a plane, through which the axis of rotation 22 runs. Through the oscillating movement of the cutting path an oscillation of the trench wall cutter can be generated.

The cutting wheel 20 comprises a cutting wheel hub 40 and an annular rim 44 fixed thereon in particular in a releasable and/or adjustable manner. The annular rim 44 can be fixed on the cutting wheel hub 40 by means of screw or bolt connections 42. Through appropriate selection of the fixing means the position of the annular rim 44 can be adjusted with respect to the cutting wheel hub 40. In this manner, the eccentricity of the annular rim 44 can be variably set. For adjustment of the annular rim 44 with respect to the cutting wheel hub 40 provision can be made for example for slotted holes on the cutting wheel hub 40 or the annular rim 44, which permit a different positioning of the annular rim 44 with respect to the cutting wheel hub. The center 46 represents, in particular, a geometrical center of the annular rim 44. Alternatively, the annular rim 44 can be firmly connected to the cutting wheel hub 40. The cutting wheel 20 thus formed as a fixed assembly group can then be adjusted radially by way of an adjustment means located between the cutting wheel 20 and a drive shaft that protrudes in an approximately perpendicular fashion from the bearing shield 14 of the cutter frame 12.

Figure 3:
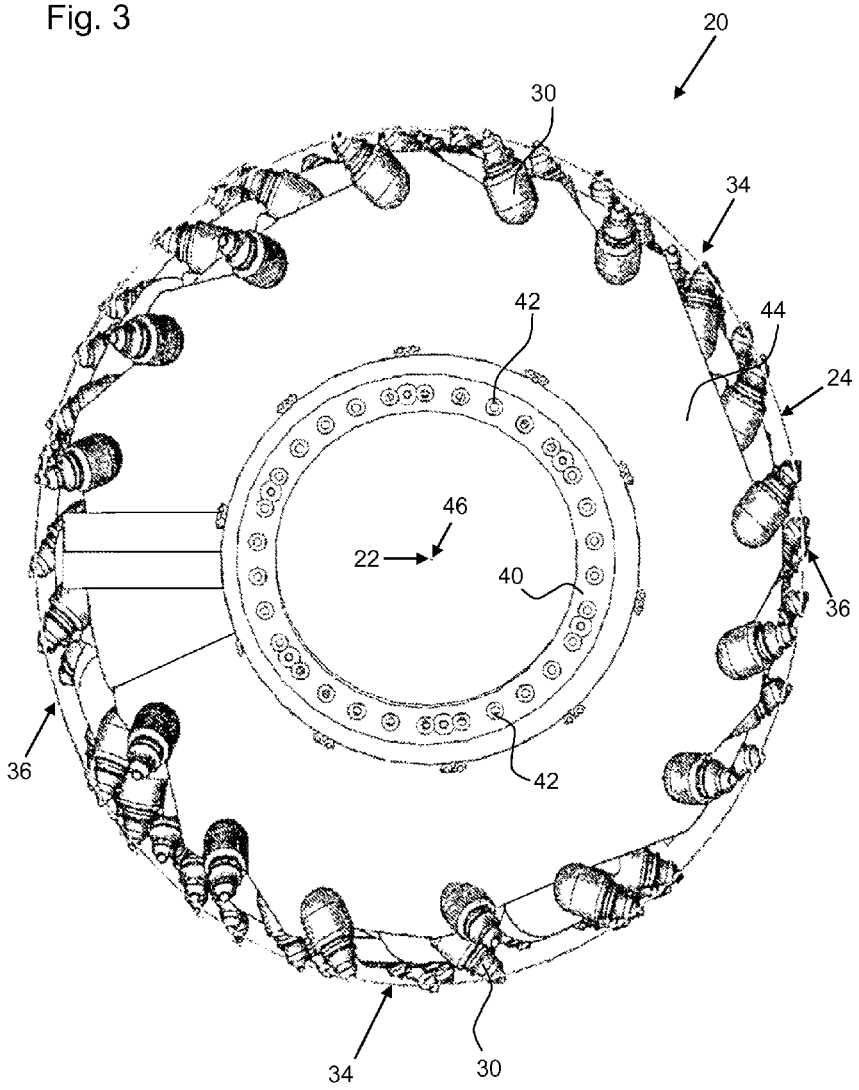
FIG. 3 a second embodiment of a cutting wheel according to the invention and FIG. 4 a third embodiment of a cutting wheel according to the invention.

Another embodiment of a cutting wheel according to the invention is depicted in FIG. 3. In contrast to the embodiment according to FIG. 2, the geometrical center 46 of the annular rim 44 or the annular path 32 is identical with the axis of rotation 22, i.e. annular rim 44 and cutting wheel hub 40 are arranged coaxially to each other. To provide the oscillating cutting path or rather the defined non-circular running of the cutting wheel 20 the ground working tools 30 are arranged on an elliptical path around the center 46. Hence, the annular path 32, on which the ground working tools 30 are arranged in the circumferential direction of the cutting wheel 20, is designed as an elliptical path. According to the elliptical annular path 32 two first circumferential sections 34 with a larger distance from the axis of rotation 22 and two second circumferential sections 36 with a smaller distance from the axis of rotation 22 are present along a circumference of the cutting wheel 20. With this cutting wheel 20 two up and down movements and thus an oscillation can be generated per revolution. Through a phase shift of the further cutting wheels 20 in relation to each other several superposed oscillations can be set.

Figure 4:
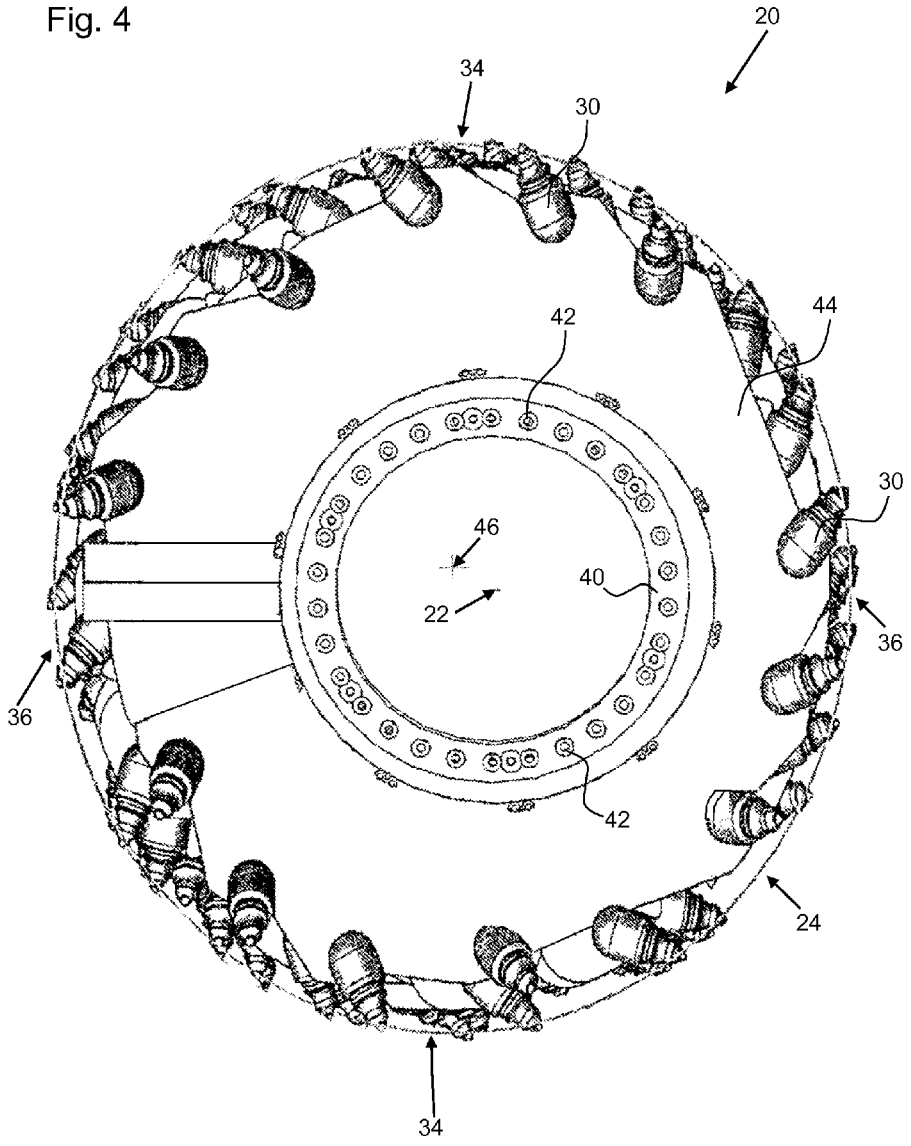

Another embodiment of a cutting wheel 20 according to the invention is shown in FIG. 4. The cutting wheel 20 shown in FIG. 4 combines features of the cutting wheels 20 of FIGS.

2 and 3. The cutting wheel 20 has an elliptical annular path 32 of the ground working tools 30. In addition, the axis of rotation 22 of the cutting wheel 20 is offset with respect to the geometrical center 46 of the annular path 32 and the annular rim 44 respectively. In this way, an especially effective amplification of impulse can be achieved during ground removal. Per revolution of the cutting wheel 20 up and down movements with different amplitudes can be generated during ground removal. Depending on the desired kinematics or oscillation of the cutting wheel 20 different alignments of the offset of the center 46 with respect to the axis of rotation 22 are possible. For instance, the oscillation resulting from the elliptical annular path 32 can be amplified by aligning the offset along the long axis or the semi-axis of the ellipse. In particular, in this way the oscillation per revolution is amplified at one time and attenuated at another time. Alternatively, depending on the desired cutting curve, it is also possible to arrange the offset obliquely or transversely to the long axis of the ellipse, as shown in FIG. 4.

On account of the oscillating cutting path of the cutting wheel 20 during rotation a defined oscillation corresponding to the oscillating cutting path can be transmitted to the trench wall cutter 10 and the cutter frame 12 respectively. Hence, during operation the trench wall cutter 10 or the cutter frame 12 moves periodically up and down in line with the circumferential sections 34, 36 with a larger and smaller distance from the axis of rotation 22. This brings about an increase in the impulse forces present on the ground working tools 30 as well as an improvement of ground removal whilst reducing frictional wear on the ground working tools 30.

The invention claimed is:

1. Trench wall cutter for producing a trench in the ground having a cutter frame at least one cutting wheel which is supported in a rotatable manner about an axis of rotation on the cutter frame and said at least one cutting wheel has an outer circumference and a plurality of ground working tools provided around the outer circumference of the cutting wheel for removing ground material, said ground working tools are arranged along an annular path around the axis of rotation, wherein said axis of rotation extends substantially horizontal direction during an operation of the trench wall cutter;

the annular path runs asymmetrically to the axis of rotation of the cutting wheel, wherein the annular path has at least one first circumferential section with a larger distance from the axis of rotation and at least one second circumferential section with a smaller distance from the axis of rotation, and wherein said plurality of ground cutting tools have at least two sets of cutting tools arranged around the circumferential surface of the cutting wheel where a first set of the cutting tools are arranged at a position different from a position of the second set of cutting tools in the direction of the axis of rotation, at least one of the first set of cutting tools is not in alignment with at least one of the second set of cutting tools along a line extending in parallel with said axis of rotation of the cutting wheel, and the position of the annular path is adjustable with respect to the axis of rotation of the cutting wheel.

2. Trench wall cutter according to claim 1, wherein as a result of the annular path running asymmetrically to the axis of rotation of the cutting wheel a defined oscillation of the trench wall cutter can be generated.

3. Trench wall cutter according to claim 1, wherein the distance of the ground working tools from the axis of rotation ranges between one and five maxima in one revolution along the annular path.

4. Trench wall cutter according to claim 1, wherein the annular path, along which the ground working tools are arranged, has a shape deviating from a circular path having an elliptical shape.

5. Trench wall cutter according to claims 1, wherein the axis of rotation of the cutting wheel is offset with respect to a geometrical ring center of the annular path.

6. Trench wall cutter according to claim 1, wherein the annular path is a circular path, the center of which is arranged eccentrically to the axis of rotation.

7. Trench wall cutter according to claim 1, wherein a cutting wheel hub is provided which is arranged concentrically to the axis of rotation and driven in a rotatable manner about the axis of rotation, the ground working tools are releasably fixed in an annular rim, and the annular rim is releasably and/or adjustably fixed on the cutting wheel hub.

8. Trench wall cutter according to claim 1, wherein several cutting wheels are supported on the cutter frame, said several cutting wheels rotate synchronously to each other in a controlled manner.

9. Trench wall cutter according to claim 1, wherein several cutting wheels are supported on the cutter frame, said several cutting wheels rotate asynchronously to each other in a controlled manner.

10. Trench wall cutter according to claim 1, wherein a supply means for supplying a hardening medium is arranged on the cutter frame.

11. Cutting device having a carrier implement, on which said trench wall cutter according to claim 1 is arranged substantially in a vertically adjustable manner.

12. Trench wall cutter according to claim 1, wherein the cutting wheel includes:

a wheel hub having a geometrical center which coincides with the axis of rotation of the cutting wheel; and an annular rim provided around the wheel hub where the annular rim has a geometrical center which does not coincide with the axis of rotation of the cutting wheel; and wherein the annular rim is fixed around the wheel hub via screw or bolt connection in such a manner that the radial and angular position of the annular rim is adjustable around the wheel hub so that the position of the annular path of the cutting wheel is adjustable with respect to the axis of rotation of the cutting wheel.

* * * * *